US012503749B2

(12) United States Patent
Suzuki et al.

(10) Patent No.: US 12,503,749 B2
(45) Date of Patent: Dec. 23, 2025

(54) NI-BASED ALLOY FOR HOT DIE, AND HOT FORGING DIE USING SAME

(71) Applicant: PROTERIAL, LTD., Tokyo (JP)

(72) Inventors: Shogo Suzuki, Tokyo (JP); Masayoshi Date, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 349 days.

(21) Appl. No.: 17/999,166

(22) PCT Filed: May 25, 2021

(86) PCT No.: PCT/JP2021/019824

§ 371 (c)(1),
(2) Date: Nov. 17, 2022

(87) PCT Pub. No.: WO2021/241585

PCT Pub. Date: Dec. 2, 2021

(65) Prior Publication Data

US 2023/0193426 A1 Jun. 22, 2023

(30) Foreign Application Priority Data

May 26, 2020 (JP) ..... 2020-091663

(51) Int. Cl.
*C22C 19/05* (2006.01)
*B21J 13/02* (2006.01)

(52) U.S. Cl.
CPC ..... *C22C 19/057* (2013.01); *B21J 13/02* (2013.01)

(58) Field of Classification Search
CPC ..... C22C 19/057; C22C 19/056; C22F 1/10
See application file for complete search history.

(56) References Cited

U.S. PATENT DOCUMENTS

| | | | | |
|---|---|---|---|---|
| 6,419,763 | B1 * | 7/2002 | Konter | C22C 19/057 148/404 |
| 11,326,231 | B2 * | 5/2022 | Suzuki | C22C 19/057 |
| 2007/0163682 | A1 * | 7/2007 | Tamaki | C22C 19/057 420/444 |
| 2020/0094309 | A1 | 3/2020 | Suzuki et al. | |
| 2020/0222969 | A1 | 7/2020 | Suzuki et al. | |
| 2020/0269308 | A1 | 8/2020 | Suzuki et al. | |
| 2020/0340081 | A1 | 10/2020 | Suzuki et al. | |
| 2020/0370148 | A1 | 11/2020 | Suzuki et al. | |
| 2021/0023606 | A1 | 1/2021 | Suzuki et al. | |

FOREIGN PATENT DOCUMENTS

| | | | |
|---|---|---|---|
| CN | 110777284 | A | 2/2020 |
| JP | H0441642 | A | 2/1992 |
| JP | H06254648 | A | 9/1994 |
| JP | H0885838 | A | 4/1996 |
| JP | H0892676 | A | 4/1996 |
| WO | 2017204286 | A1 | 11/2017 |
| WO | 2018117226 | A1 | 6/2018 |
| WO | 2019065542 | A1 | 4/2019 |
| WO | 2019065543 | A1 | 4/2019 |
| WO | 2019106922 | A1 | 6/2019 |
| WO | 2019107502 | A1 | 6/2019 |
| WO | 2020059846 | A1 | 3/2020 |

OTHER PUBLICATIONS

"English language translation of International Search Report", International Application No. PCT/JP2021/019824, Aug. 17, 2021, 2 pp.

* cited by examiner

*Primary Examiner* — Jessee R Roe
(74) *Attorney, Agent, or Firm* — Myers Bigel, P.A.

(57) ABSTRACT

Provided are a Ni-based alloy for a hot die having high high-temperature compressive strength, oxidation resistance, and tensile strength and capable of yielding high productivity or long die service life, and a hot forging die using the Ni-based alloy for hot die. A Ni-based alloy for hot die comprising, in mass %, W: 12.0 to 16.0%, Mo: 1.0 to 5.0%, Al: 5.0 to 7.5%, Cr: 0.5 to 5.0%, Ta: 0.5 to 7.0%, Ti: 0.1 to 3.5%, C: 0.01 to 0.25%, N: 0.0005 to 0.01%, B: 0.05% or less, S: 0.015% or less, one or two or more elements selected from rare earth elements, Y, Ca, and Mg: 0 to 0.020% in total, one or two elements selected from Zr and Hf: 1.5% or less in total, Nb: 3.5% or less, Co: 15.0% or less, the balance being Ni and inevitable impurities, wherein C and N satisfy the following relational expression 1:

$$C/100 \leq N \leq C,$$

wherein C and N in the expression mean mass % of each component content.

8 Claims, 9 Drawing Sheets

COMPARATIVE EXAMPLE NO.21 (200 TIMES)

EXAMPLE NO.1 (200 TIMES)

EXAMPLE NO.2 (200 TIMES)

COMPARATIVE EXAMPLE NO.21 (500 TIMES)

EXAMPLE NO.1 (500 TIMES)

EXAMPLE NO.2 (500 TIMES)

EXAMPLE NO.3

EXAMPLE NO.4

EXAMPLE NO.5

COMPARATIVE EXAMPLE NO.21

EXAMPLE NO.1

COMPARATIVE EXAMPLE NO.21

EXAMPLE NO.1

22°C

1100°C

COMPARATIVE EXAMPLE NO.21

EXAMPLE NO.1

EXAMPLE NO.2

COMPARATIVE EXAMPLE NO.21
(ROOM TEMPERATURE(22°C))

EXAMPLE NO.1
(ROOM TEMPERATURE(22°C))

EXAMPLE NO.2
(ROOM TEMPERATURE(22°C))

COMPARATIVE EXAMPLE NO.21 (1100°C)

EXAMPLE NO.1 (1100°C)

EXAMPLE NO.2 (1100°C)

NI-BASED ALLOY FOR HOT DIE, AND HOT FORGING DIE USING SAME

RELATED APPLICATIONS

This application is a 35 U.S.C. § 371 national stage application of PCT Application No. PCT/JP2021/019824, filed on May 25, 2021, which claims priority from Japanese Patent Application No. 2020-091663, filed on May 26, 2020, the contents of which are incorporated herein by reference in their entireties. The above-referenced PCT International Application was published in the Japanese language as International Publication No. WO 2021/241585 A1 on Dec. 2, 2021.

TECHNICAL FIELD

The present invention relates to a Ni-based alloy for a hot die, and to a hot forging die using the same.

BACKGROUND ART

In the forging of a product made of heat-resistant alloy, forging material is heated to a predetermined temperature to reduce deformation resistance. The heat-resistant alloy has a high strength even at a high temperature and a hot forging die to be used in the forging of the heat-resistant alloy is required to have high mechanical strength at a high temperature. When the temperature of a hot forging die is lower than the temperature of a forging material in hot forging, the workability of the forging material decreases due to die chilling, and thus, products of poor workability materials such as Alloy 718 and Ti alloy are forged by heating the hot forging die with the material. Consequently, the hot forging die should have high mechanical strength at a high temperature equal to or near the temperature to which the forging material is heated. As a hot forging die that satisfies this requirement, a Ni-based heat-resistant superalloy that has high high-temperature compressive strength and can be used in hot forging at a die temperature of 1000° C. or more in the air has been proposed (for example, see Patent Documents 1 to 7).

The most important property of hot forging dies is high-temperature compressive strength, but tensile thermal stress is generated in the dies due to the temperature difference between the inside and outside of the dies, which occurs when the dies are heated to the target temperature. Also, since the stress is repeatedly applied when the dies are used repeatedly, a certain amount of tensile strength is also required. Unlike the compressive stress applied to the die during the compressive processing of the material, which is largely determined by the deformation resistance of the material, the tensile thermal stress can be reduced to some extent by devising a heating method. For example, an isothermal forging method has been proposed in which the temperature of a die is gradually raised to a target temperature while a fixed holding time is provided (Patent Document 8).

As used herein, the term hot forging includes hot die forging in which the temperature of the hot forging die is made close to the temperature of the forging material and isothermal forging in which the hot forging die is heated to the same temperature as the forging material.

REFERENCE DOCUMENT LIST

Patent Documents

Patent Document 1: WO 2017/204286 A1
Patent Document 2: WO 2018/117226 A1

Patent Document 3: WO 2019/065542 A1
Patent Document 4: WO 2019/065543 A1
Patent Document 5: WO 2019/106922 A1
Patent Document 6: WO 2019/107502 A1
Patent Document 7: WO 2020/059846 A1
Patent Document 8: JP H6-254648 A

SUMMARY OF THE INVENTION

Problem to be Solved by the Invention

In the Ni-based heat-resistant superalloy described above, the tensile strength is not taken to be important because the alloy is designed mainly for the purpose of increasing the high-temperature compressive strength and the oxidation resistance. Even when the tensile strength is relatively low, the dies can be repeatedly used to a certain extent without damage by using the die heating method as described above, but in this case, the time required to raise the temperature to the target temperature becomes longer and productivity deteriorates. This problem is particularly pronounced in large dies having a diameter of approximately 500 mm or more, for example, where the temperature difference between the inside and outside of the die tends to increase. When the tensile strength is increased, the heating time of the die can be shortened, and when the tensile thermal stress is set to the same level, the fatigue life of the die in repeated use can be extended.

An object of the present invention is to provide a Ni-based alloy for a hot die having high high-temperature compressive strength, oxidation resistance, and tensile strength, which is advantageous especially in use in large dies, and is capable of achieving high productivity or long die service life, and a hot forging die using the Ni-based alloy for hot die.

Means for Solving the Problem

The present inventors have studied the problems described above and found a composition having high high-temperature compressive strength, oxidation resistance and tensile strength, and thereby achieved the present invention.

That is, the present invention provides a Ni-based alloy for hot die comprising, in mass %, W: 9.0 to 16.0%, Mo: 1.0 to 8.0%, Al: 5.0 to 7.5%, Cr: 0.5 to 5.0%, Ta: 0.5 to 7.0%, Ti: 0.1 to 3.5%, C: 0.01 to 0.25%, N: 0.0005 to 0.02%, B: 0.05% or less, S: 0.015% or less, one or two or more elements selected from rare earth elements, Y, Ca, and Mg: 0.020% or less in total, one or two elements selected from Zr and Hf: 1.5% or less in total, Nb: 3.5% or less, Co: 15.0% or less, the balance being Ni and inevitable impurities, wherein C and N satisfy the following relational expression 1:

$$C/100 \leq N \leq C,$$

wherein C and N in the expression mean mass % of each component content.

In another embodiment of the Ni-based alloy for hot die of the present invention, when a cross-section of the Ni-based alloy for hot die is observed in a field of view area of at least 1000 $\mu m^2$, a ratio of carbides having a circularity greater than 0.5 among carbides having a size of 0.25 to 200 $\mu m^2$ seen in the field of view area is 90% or more.

In another embodiment of the Ni-based alloy for a hot die of the present invention, when a cross-section of the Ni-based alloy for hot die is observed in a field of view area of at least 1000 $\mu m^2$, a ratio of branched carbides having a length/width of 10 or more among carbides having a size of 0.25 to 200 $\mu m^2$ seen in the field of view area is 10% or less.

The present invention further provides a hot forging die using the Ni-based alloy for a hot die.

Effects of the Invention

According to the present invention, it is possible to obtain a Ni-based alloy for a hot die having high high-temperature compressive strength, oxidation resistance, and tensile strength, and it is possible to obtain a hot forging die using the Ni-based alloy. This makes it possible to achieve high productivity or long die service life.

MODE FOR CARRYING OUT THE INVENTION

Figure 1A:
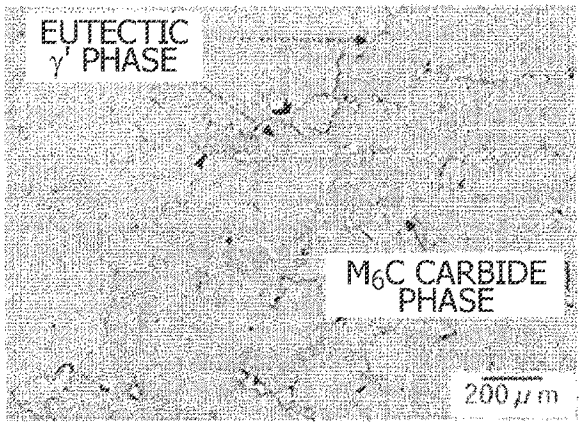
FIGS. 1A-1F show optical micrograph photos of microstructures of the examples and the comparative example.
Figure 1B:
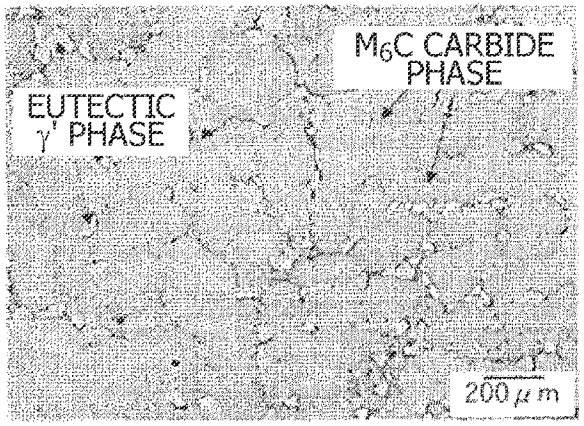
Figure 1C:
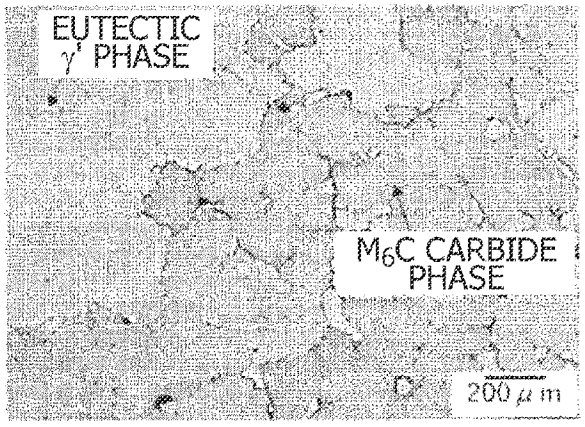
Figure 1D:
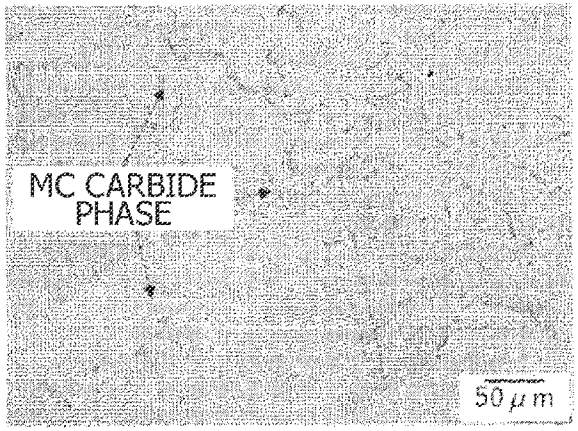
Figure 1E:
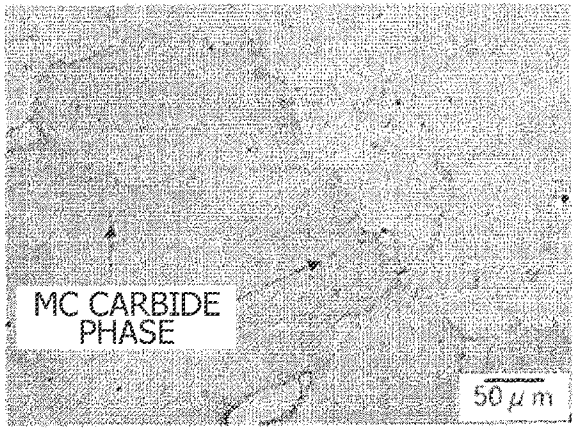
Figure 1F:
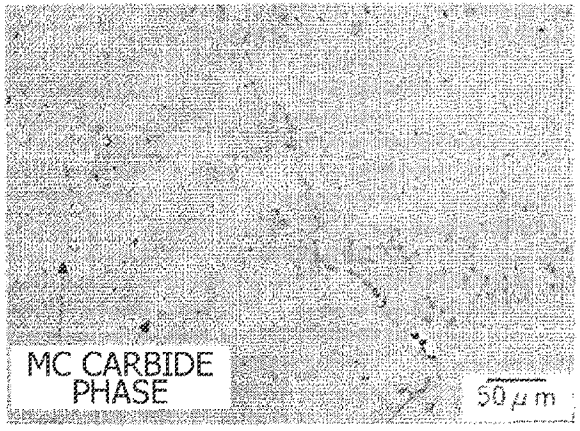

Hereinafter, the Ni-based alloy for hot die of the present invention will be described in detail. The unit for the chemical composition is mass %. The content "or less" includes 0%. Furthermore, in the following description of the chemical composition, MC carbide refers to a fine carbide having a size of 0.25 to 200 $\mu m^2$, and $M_6C$ carbide refers to a large carbide exceeding 200 $\mu m^2$. These identification methods will be described later.

W: 9.0 to 16.0%

W dissolves in an austenitic matrix, and also dissolves in a gamma prime phase (hereinafter referred to as γ' phase) basically composed of $Ni_3Al$ that is a precipitation strengthening phase to increase the high-temperature strength of the alloy. Furthermore, W forms MC carbide together with C, which will be described later, and precipitates at the grain boundaries to enhance the grain boundary strength, thereby enhancing the tensile strength. In addition, W has an effect of reducing the oxidation resistance and an effect of facilitating the precipitation of harmful phases such as the TCP (Topologically Close Packed) phase. From the viewpoint of enhancing the high-temperature strength and tensile strength and suppressing the reduction of the oxidation resistance and the precipitation of harmful phases, the content of W in the Ni-based alloy according to the present invention is 9.0 to 16.0%. In order to more reliably achieve the effect of W, the lower limit is preferably 10.0%, more preferably 12.0%, and still more preferably 13.0%. Furthermore, the upper limit of W is preferably 15.5%, and the upper limit is more preferably 15.0%.

Mo: 1.0 to 8.0%

Mo, like W, dissolves in an austenitic matrix, and also dissolves in the γ' phase basically composed of $Ni_3Al$ that is a precipitation strengthening phase to increase the high-temperature strength of the alloy. In addition, Mo also has an effect of reducing the oxidation resistance and an effect of facilitating the precipitation of harmful phases such as the TCP phase. Furthermore, an excess content of Mo also leads to the formation of carbides together with W described above and C described later, which act as a fracture origin and a decrease in the amount of solid solute during holding at a high temperature. In particular, the $M_6C$ carbide tends to aggregate, and areas where $M_6C$ carbide coarsens and further aggregates have a high risk of fatigue failure. From the viewpoint of enhancing the high-temperature strength and suppressing oxidation resistance and formation of $M_6C$ carbides, the content of Mo in the Ni-based alloy according to the present invention is 1.0 to 8.0%, which is equal to or less than the W content. In order to more reliably achieve the effect of Mo, the lower limit is preferably 1.5%, the upper limit is preferably 7.0%, and the upper limit is more preferably 5.0%. Mo is preferably in the range of 1.0 to 5.0%, and it is more preferable that the upper limit of Mo is 4.0% in said range.

Al: 5.0 to 7.5%

Al has effects of bonding to Ni to precipitate a γ' phase composed of $Ni_3Al$, enhancing the high-temperature strength of the alloy, producing an alumina film on the surface of the alloy, and imparting the oxidation resistance to the alloy. In addition, an excess content of Al also has an effect of excessively producing eutectic γ' phases to reduce the high-temperature strength and the toughness of the alloy. From the viewpoint of enhancing the oxidation resistance and the high-temperature strength and suppressing the reduction of the toughness, the content of Al in the Ni-based alloy of the present invention is 5.0 to 7.5%. In order to more reliably achieve the effect of Al, the lower limit is preferably 5.2%, and the lower limit is more preferably 5.4%. The upper limit of Al is preferably 6.7%, and the upper limit is more preferably 6.5%.

Cr: 0.5 to 5.0%

Cr has effects of promoting the formation of a continuous layer of alumina on the surface of or inside the alloy and increasing the oxidation resistance of the alloy. Thus, 0.5% or more of Cr is required to be contained. In addition, an excess content of Cr also has an effect of facilitating the precipitation of harmful phases such as the TCP phase. Particularly when the austenitic matrix or the γ' phase contains a large amount of elements such as W, Mo, Ta, and Ti that increase the high-temperature strength of the alloy, harmful phases are likely to be precipitated. From the viewpoint of increasing the oxidation resistance and suppressing the precipitation of harmful phases while maintaining the content of elements that increase the high-temperature strength at a high level, the content of Cr according to the present invention is 0.5 to 5.0%. In order to more reliably achieve the effect of Cr, the lower limit is preferably 1.2%, and the upper limit of Cr is preferably 3.0%, and is more preferably 2.0%.

Ta: 0.5 to 7.0%

Ta dissolves by substituting into the Al site in a γ' phase composed of $Ni_3Al$, thereby enhancing the high-temperature strength of the alloy. Ta increases the adhesion and the oxidation resistance of an oxide film formed on the alloy surface, and has an effect of further increasing the oxidation resistance of the alloy. Furthermore, Ta forms MC carbide together with C, which will be described later, and precipitates at the grain boundaries to enhance the grain boundary strength, thereby enhancing the tensile strength. In addition, an excess content of Ta also has an effect of facilitating precipitation of harmful phases such as the TCP phase and an effect of excessively producing eutectic γ' phases to reduce the high-temperature strength and the toughness of the alloy. From the viewpoint of enhancing the oxidation resistance and the high-temperature strength and suppressing the reduction of toughness and the precipitation of harmful phases, the content of Ta in the present invention is 0.5 to 7.0%. In order to more reliably achieve the effect of Ta, the lower limit is preferably 2.5%, and the upper limit of Ta is preferably 6.5%, and the upper limit is more preferably 5.0%.

Ti: 0.1 to 3.5%

When Ti is contained together with N and C, which will be described later, the nitride formed together with N acts as a precipitation nucleus of the MC carbide formed together with C, thereby finely dispersing the carbide in a preferable morphology and enhancing tensile strength. Furthermore, similar to Ta, Ti dissolves by substituting into the Al site in a γ' phase composed of $Ni_3Al$, thereby enhancing the high-temperature strength of the alloy. Furthermore, Ti is a low-cost element as compared with Ta and advantageous in terms of die cost. In addition, an excess content of Ti has, like Ta, also has an effect of facilitating precipitation of harmful phases such as the TCP phase and an effect of excessively producing eutectic γ' phases to reduce the high-temperature strength and the toughness of the alloy. From the viewpoint of enhancing the tensile strength and the high-temperature strength and suppressing the reduction of toughness and the precipitation of harmful phases, the content of Ti in the present invention is 0.1 to 3.5%. In order to more reliably achieve the effect of Ti, the lower limit is preferably 0.5%, and the upper limit of Ti is preferably 3.0%, and the upper limit is more preferably 2.0%. Since the lower limit value of Ti in the present invention is sufficiently higher than the upper limit value of N, which will be described later, the content of Ti in the present invention is sufficient for forming a nitride together with N.

C: 0.01 to 0.25%

C forms MC carbide together with W, Mo, Ta, Ti, and Nb, and Zr and Hf described later, and precipitates at the grain boundaries to enhance the grain boundary strength, thereby enhancing the tensile strength. In addition, an excess content of Mo also has an effect of reducing the high-temperature strength of the alloy due to the formation of coarse carbides and the significant decrease in the amount of solute Mo due to the formation of $M_6C$ carbides during holding at a high temperature. From the viewpoint of enhancing the tensile strength of the alloy and suppressing the reduction of the high-temperature strength, the content of C in the present invention is 0.01 to 0.25%. In order to more reliably achieve the effect of C, the lower limit is preferably 0.04%, the upper limit of C is preferably 0.2%, and the upper limit is more preferably 0.15%.

N: 0.0005 to 0.02%

N forms Ti-based nitride which acts as a precipitation nucleus of MC carbide, and increases tensile strength by modifying branched MC carbide morphology, commonly referred to as Chinese-script, which reduce tensile strength, to a preferable morphology from the viewpoint of suppressing excessive stress concentration, such as a block or spherical morphology, and finely dispersing MC carbides. This is because the carbide precipitates earlier in the molten metal due to the presence of the precipitation nuclei than in the molten metal having a limited volume between the dendrite arms and high element concentration due to segregation at the end of solidification, so that the carbide is finely dispersed in the flow of the molten metal while growing relatively roundly. In addition, preferential precipitation of MC carbides has an effect of suppressing the formation of coarse $M_6C$ carbides, which reduce tensile strength through the formation of cracks by its own cracking and may act as fatigue origin. In addition, an excess content of N also has an effect of reducing the tensile strength due to excessive generation of microporosity and the like. In addition, by making the grains excessively fine, the creep strength at high temperature is reduced. From the viewpoint of enhancing the tensile strength, suppressing the formation of microporosity, and suppressing a reduction in creep strength, the content of N in the present invention is 0.0005 to 0.02%. In order to more reliably achieve the effect of N, the lower limit is preferably 0.0007%, the lower limit is more preferably 0.0010%, and still more preferably 0.0050%. The upper limit of N is preferably 0.0100%. N is preferably in the range of 0.00050 to 0.0100%, and the upper limit of N is more preferably 0.0090% in said range.

Relational Expression 1

Since N acts as a nucleus together with Ti, the effects described above can be obtained even with a small amount of N in the present invention, which contains a sufficient amount of Ti as an essential element. In addition, an excess content of N reduces tensile strength and creep strength. Therefore, it is reasonable that N is contained in an amount corresponding to the content of C within the range described above. When N is contained in an amount of C or more, not only the saturation of the effect and the reduces in strength, but also other properties such as fatigue strength may also be reduced due to the precipitation of coarse nitride by the excess N. Therefore, in the present invention, the upper limit of the content of N is the content of C. The upper limit is preferably 1/10 of C. In addition, it is not necessary for N and Ti to act as precipitation nuclei for all MC carbides, but only for branched MC carbides. The size of the MC carbide and the ratio of the branched MC carbide are affected by other components of the alloy and the cooling rate at the time of solidification, and the required amount of precipitated nuclei varies slightly according to them, but in the present invention, 1/100 of C is used as the lower limit of the content of N. The lower limit is preferably 1/50 of C.

B

The Ni-based alloy for hot die according to the present invention can contain 0.05% or less (including 0%) of B (boron). B, like carbides, increases the strength of grain boundaries of the alloy and enhances the tensile strength and the ductility. In addition, an excess content of B causes the formation of a coarse boride and also has an effect of reducing the strength of the alloy. In addition, there is a risk of high-temperature cracking due to local melting during use due to the formation of a low melting point boride, and solidification cracking during casting due to an excessively wide solid-liquid coexistence temperature range. Therefore, B may be added as necessary when the operating temperature is low or when the shape of the casting material is simple and the risk of solidification cracking is low. In order to reliably achieve the effect of B, the lower limit is preferably 0.01%, and the upper limit is preferably 0.03%.

S, Rare Earth Elements, Y, Ca, and Mg

Furthermore, in the Ni-based alloy for hot die according to the present invention, S (sulfur) prevents the reduction of the adhesion of the oxide film through the segregation to the interface between the oxide film formed on the alloy surface and the alloy as well as the inhibition of the chemical bonding between them. Therefore, it is preferable that while regulating the upper limit of S to 0.015% or less (including 0%), one or two or more selected from rare earth elements, Y, Ca, and Mg that form sulfide with S are contained within a range of 0.020% or less in total. As for these rare earth elements, Y, Ca, and Mg, the excess addition of these elements causes an increase in the eutectic γ' phases, or the like, and consequently reduces the toughness. Therefore, the upper limit of the total amount of rare earth elements, Y, Ca and Mg is 0.020%. S is a component contained as impurities and remains greater than 0%. When the content of S is likely to be 0.0001% (1 ppm) or more, one or two or more elements selected from rare earth elements, Y, Ca, and Mg may be contained in an amount of equal to or greater than the content of S. In the Ni-based alloy of the present invention, when the S content can be suppressed to a low range of, for example, 0.0002% or less, the elements of the rare earth elements, Y, Ca, and Mg may be 0% (not added).

Among the rare earth elements, La is preferably used. In addition to the effect of preventing the segregation of S, La also has an effect of suppressing the diffusion at grain boundaries of the oxide film described below, and these effects are excellent, so La is preferably selected among the rare earth elements. From an economic viewpoint, Ca or Mg is preferably used. In addition, Mg has a smaller effect of reducing toughness and ductility than Ca, and can be expected to have an effect of preventing cracking during casting, and thus Mg is preferably used when any of the rare earth elements, Y, Ca, and Mg is selected. When a sufficient effect can be obtained by the addition of Mg, Ca is not added. In order to reliably achieve the effect of Mg, it is preferable that 0.0002% or more of Mg is contained, regardless of the presence or absence of S. Mg is preferably 0.0005% or more, and more preferably 0.0010% or more.

Zr and Hf

The Ni-based alloy for a hot die according to the present invention can contain one or two elements selected from Zr and Hf within a range of 1.5% or less (including 0%) in total. Zr and Hf suppress the diffusion of metal ions and oxygen at the grain boundary by segregation of the oxide film into the grain boundary. This suppression of grain boundary diffusion reduces the growth rate of the oxide film and changes the growth mechanism of promoting the spallation of the oxide film, which increases the adhesion between the film and the alloy. That is, these elements have an effect of increasing the oxidation resistance of the alloy due to the reduction of the growth rate and the increase of the oxide film adhesion described above. In addition, Zr and Hf form MC carbide together with C, and have an effect of enhancing the grain boundary strength.

In order to reliably achieve the effect of these, the alloy preferably contains 0.01% or more of one or two elements selected from Zr and Hf in total. Furthermore, the lower limit is preferably 0.02%, and more preferably 0.05%. In addition, excess addition of Zr and Hf causes the excess production of intermetallic compounds between them and Ni and the like and an increase in the eutectic γ' phases, or the like, and reduces the toughness of the alloy, and thus, the upper limit of one or two elements selected from Zr and Hf in total is 1.5%. Furthermore, the upper limit is preferably 1.0%, and the upper limit is more preferably 0.2%. Incidentally, since Hf can be expected to have an effect of preventing cracking during casting, it is preferable to use Hf when selecting either Zr or Hf.

The rare earth elements and Y also have an effect of suppressing the diffusion at grain boundaries of the oxide film. However, these elements have a higher effect of lowering toughness than Zr and Hf, and the upper limit value of the content is low. Therefore, as the element contained for the purpose of this action, Zr and Hf are more suitable than the rare earth elements and Y. Consequently, in order to enhance the oxidation resistance and the toughness in a balanced manner, Hf and Mg are particularly preferably simultaneously used.

Co

The Ni-based alloy for hot die according to the present invention can contain Co. Co dissolves in an austenitic matrix to enhance the high-temperature strength of the alloy. In addition, an excess content of Co increases the die cost since Co is an expensive element as compared with Ni, and Co has an effect of facilitating the precipitation of harmful phases such as the TCP phase. Since the solid solution strengthening ability of Co is lower than that of W and Mo, the addition of Co is not essential when a superior high-temperature strength is achieved by adjusting the content of W and Mo. When an increase in cost is acceptable, Co may be added as necessary. In the present invention, from the viewpoint of enhancing the high-temperature strength and suppressing the increase in die cost and the precipitation of harmful phases, Co can be contained within a range of 15.0% or less (including 0%). In order to reliably achieve the effect of Co, the lower limit is preferably 0.5%, and more preferably 2.5%. The upper limit is preferably 13.0%.

Nb

The Ni-based alloy for hot die according to the present invention can contain Nb. Nb dissolves by substituting into the Al site in a γ' phase composed of $Ni_3Al$, thereby enhancing the high-temperature strength of the alloy. Furthermore, Nb is a low-cost element as compared with Ta and advantageous in terms of die cost. In addition, an excess content of Nb, like Ta, also has an effect of facilitating precipitation of harmful phases such as the TCP phase and an effect of excessively producing eutectic γ' phases to reduce the high-temperature strength and the toughness of the alloy. Nb has no effect of increasing the oxidation resistance, unlike Ta. In the present invention, from the viewpoint of suppressing an excessive decrease in oxidation resistance and reducing the die cost, Nb can be contained in the range of 3.5% or less (including 0%). In order to reliably achieve the effect of Nb, the lower limit is preferably 0.5%, and more preferably 1.0%. The upper limit is preferably 2.7%.

Balance

In the Ni-based alloy for hot die of the present invention, elements other than the aforementioned elements are Ni and inevitable impurities. In the Ni-based alloy for hot die according to the present invention, Ni is the main element for constituting an austenitic phase (sometimes referred to as γ or γ phase), and constitutes also a γ' phase together with Al, Ta, Ti, Nb, Mo, and W. As inevitable impurities, P, N, O, Si, Mn, Fe and the like are assumed to be contained, as well as trace amounts of V, Re, and Ru, mixed in when ingots are cast in a furnace normally used for Ni-based alloys. 0.005% or less of each of P and O may be contained and 0.5% or less of each of Si, Mn, Fe, Cu, V, Re and Ru may be contained. The Ni-based alloy for hot die of the present invention can also be referred to as the Ni-based heat-resistant alloy for hot die.

Carbide

Figure 4A:
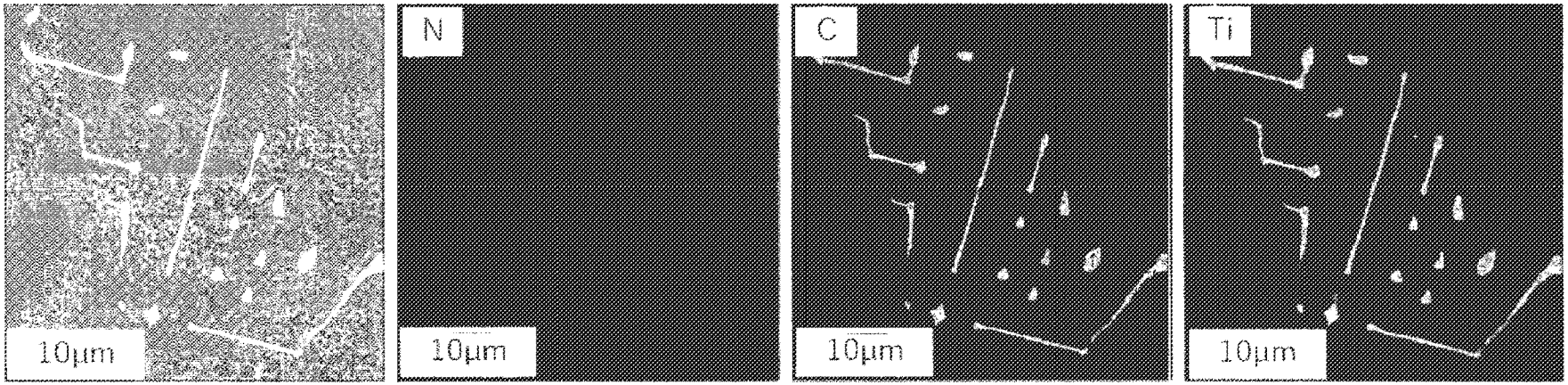
FIGS. 4A-4B show electron microscopy backscattered electron images and element maps of MC carbides of the example and the comparative example.
Figure 4B:
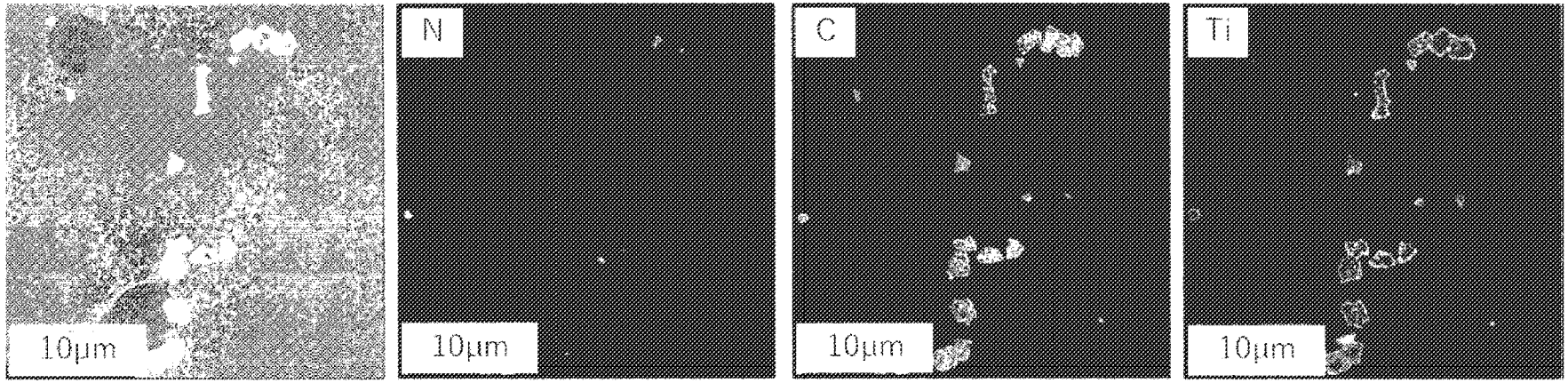

The Ni-based alloy for hot die of the present invention adjusted to the aforementioned chemical composition exhibits a characteristic MC carbide morphology. This is due, in particular, to the balance of N, C and their contents. As a particularly characteristic morphology of carbide, for example, as shown in FIGS. 4A-4B, there is one having a carbide having a nucleus of a Ti-based nitride.

In the present invention, the MC carbides are limited to those having a size of 0.25 to 200 $\mu m^2$. For example, MC carbides having a size of less than 0.25 $\mu m^2$ are considered fine enough to have no effect on deterioration of mechanical properties such as fatigue strength deterioration, even if they are branched or needle-like, and these are excluded. Furthermore, those exceeding 200 $\mu m^2$ are $M_6C$ carbides, and thus MC carbides having a size of 0.25 to 200 $\mu m^2$ are observed. The field of view area for confirming MC carbide was at least 1000 $\mu m^2$. In order to avoid variation due to observation position, it is preferable that 100 or more pieces of carbides be present in one field of view, and more preferable that 200 or more thereof be present. For that purpose, the field of view area of at least 1000 $\mu m^2$ is required when confirming MC carbide. The number of pieces of MC carbides to be analyzed is preferably at least 100 or more, and more preferably 300 or more, for accurate analysis. For that purpose, the upper limit of the field of view area when confirming MC carbide is preferably around 500000 $\mu m^2$. For observation of a field of view area of 1000 $\mu m^2$, a plurality of randomly selected fields at a magnification of around 1000 times may be observed.

During observation of the carbides, in order to confirm that the observed carbides are MC carbides, the carbides observed by an electron microscope (SEM) or an electron beam microanalyzer (EPMA) can be confirmed by element mapping with an energy dispersive X-ray analyzer (EDX) or a wavelength dispersive X-ray analyzer (WDX). For example, in the case of MC carbides, a high content of Nb, Ti, and Ta is detected, and in the case of $M_6C$ carbides, a high content of W and Mo is detected.

Furthermore, regarding the observation of the $M_6C$ carbide, since the $M_6C$ carbide is relatively large, the $M_6C$ carbide may be observed with a field of view area of 100000 $\mu m^2$ or more, preferably around 2000000 $\mu m^2$. There are cases in which $M_6C$ carbide is aggregated, the observation field of view may be selected at a low magnification of around 100 times. The observation field of view may also have a field of view area of 100000 $\mu m^2$ or more (preferably around 2000000 $\mu m^2$) as the plurality of fields of view. The identification of the observed carbides is the same as the method described above for MC carbides.

Circularity

Next, the circularity of the MC carbide will be described. One of the features of the present invention is that the ratio of carbides having a circularity greater than 0.5 is large.

The morphology of the carbide can be evaluated by the circularity defined by the following expression, which is calculated from the information obtained by analyzing photographs of the microstructure of the two-dimensional cross-section of the material with image processing software ImageJ, or the like.

$$\text{Circularity}=(4\times\pi\times\text{area of carbide})/(\text{perimeter of carbide})$$

Circularity is a numerical value indicating how close the object is to a circle, is 1 when the object is a perfect circle, and becomes closer close to 0 as the morphology becomes more complex and farther from that of a circle. When the object is a square, the circularity is approximately 0.79, and when the object is an equilateral triangle, the circularity is approximately 0.60. The circularity of the carbides is preferably close to 1, and the branched MC carbides called Chinese-script, in which the stress tends to be concentrated, has a value of less than 0.5, close to 0. Therefore, when evaluating the change of the elongated branched MC carbide into a block or spherical morphology, it is preferable to set around 0.5 as a standard. In order to improve tensile strength, MC carbides having a circularity greater than 0.5 preferably account for 90% or more of all MC carbides (that is, among the carbides having a size of 0.25 to 200 $\mu m^2$, only carbides having a circularity greater than 0.5 are "substantially" observed), and more preferably account for 95% or more.

Length to Width Ratio

In the present invention, the formation of the branched MC carbide referred to as Chinese-script can be suppressed by optimizing the chemical composition. As will be seen in the examples described below, branched MC carbides, referred to as Chinese-script, exhibit characteristic morphology. Some appear as a single needle or a series of dashed lines. Of these, those that appear needle-like have a length to width ratio of 10 or more. One of the features of the present invention is that there are many block or spherical MC carbides and there are few branched and needle-like MC carbides in which stress is easily concentrated. This branched or needle-like MC carbide can be suppressed to 10% or less in the field of view area. Preferably not more than 5% (That is, among carbides having a size of 0.25 to 200 $\mu m^2$, branched carbides having a length/width of 10 or more are not "substantially" observed), and more preferably no branched MC carbide, referred to as Chinese-script, can be confirmed (zero %).

Figure 8:
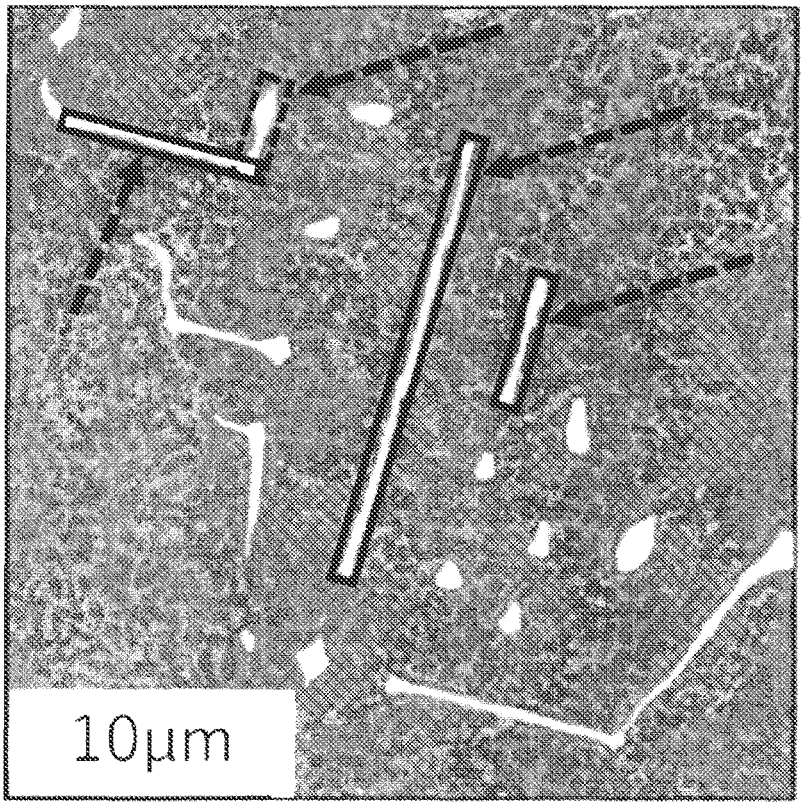
FIG. 8 is an example of a method for measuring the length and width of carbides in the comparative example.
Figure 9A:
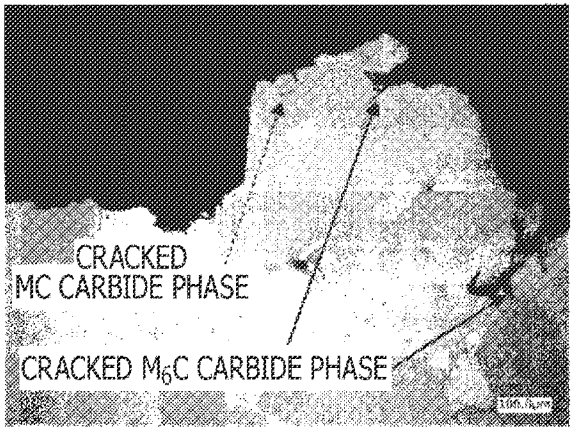
FIGS. 9A-9F show optical micrograph photos of microstructures of the cross-section in the vicinity of a fracture surface of tensile test specimens of the examples and the comparative example.
Figure 9B:
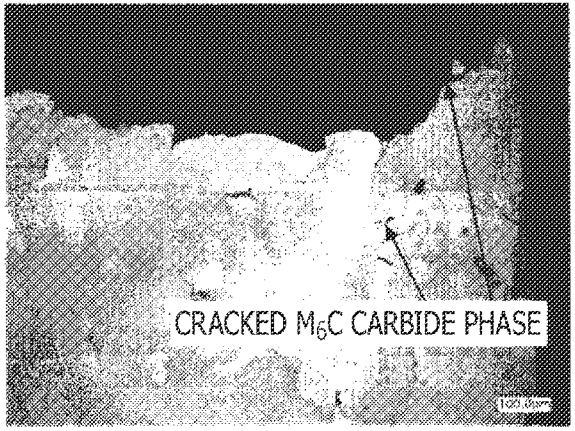
Figure 9C:
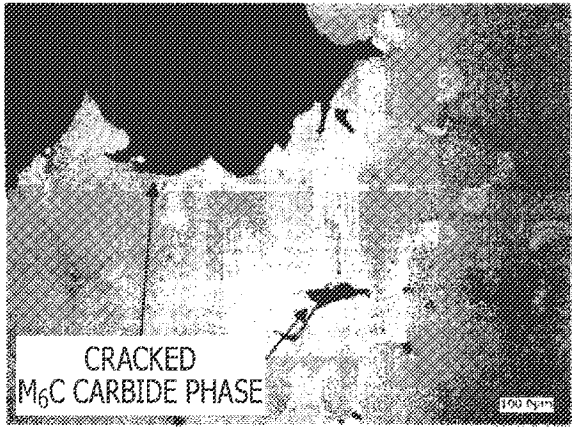
Figure 9D:
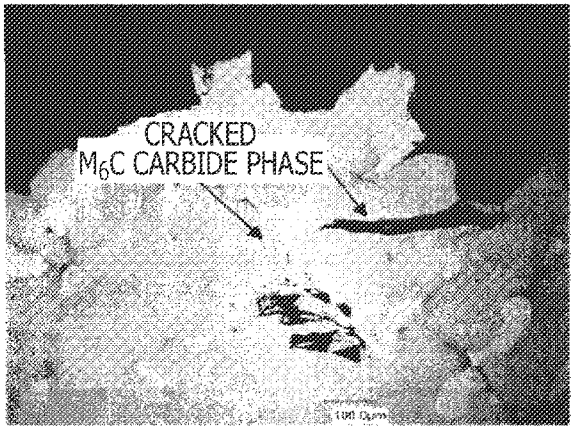
Figure 9E:
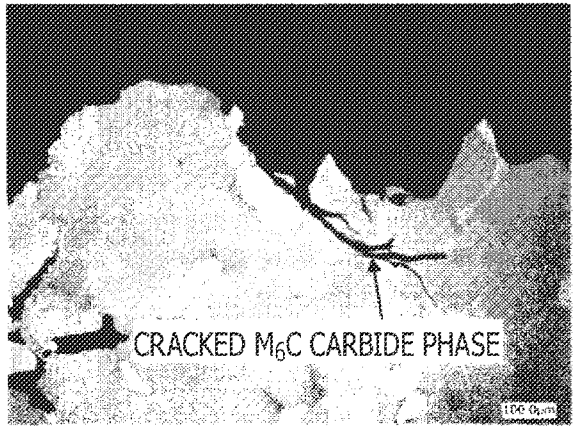
Figure 9F:
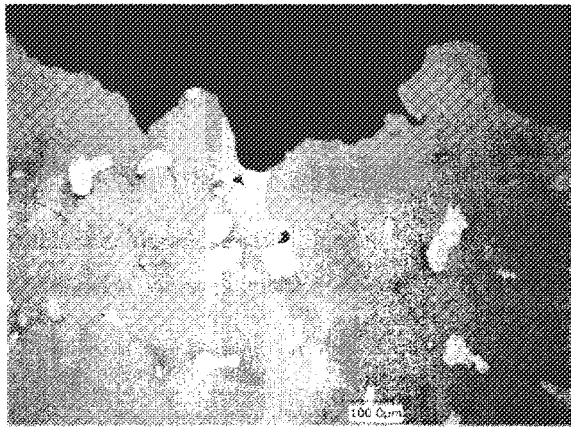

For the measurement of length and width, it is convenient to surround the carbide to be measured (indicated by the dashed arrow) with a rectangular frame and measure the long side as length and the short side as width, as shown in FIG. 8, for example. For the measurement of branched MC carbide, the length and width may be measured by surrounding each of the substantially straight portions with a rectangular frame.

Hot Forging Die

According to the present invention, a hot forging die using the Ni-based alloy for a hot die having the alloy composition described above can be constituted. At this time, it is preferable that the hot forging die also have the morphology of the carbide of the Ni-based alloy for a hot die described above. The Ni-based alloy for a hot forging die of the present invention can be obtained by casting. Furthermore, in order to suppress the generation of cracks in the material due to stress during solidification, a sand mold or a ceramic mold is preferably used as the casting mold. The atmosphere during casting may be vacuum or air, but vacuum is preferable from the viewpoint of controlling the composition with high accuracy.

At least one surface of the die surface or the side surface of the hot forging die of the present invention can be a surface having an application layer of an antioxidant. This more reliably prevents the oxidation of the die surface caused by the contact of oxygen in the air and the base material of the die at a high temperature and scattering of the scale associated therewith, allowing the deterioration in the working environment and the shape deterioration to be prevented. The antioxidant described above is preferably an inorganic material formed by any one or more of nitride, oxide, carbide. This is for forming dense oxygen blocking films by the application layer formed by nitride, oxide, or carbide and for preventing the oxidation of a die base material. The application layer may be a single layer of nitride, oxide, and carbide, or may be a lamination structure formed by combining any two or more of nitride, oxide, and carbide. Furthermore, the application layer may be a mixture of any two or more of nitride, oxide, and carbide.

The hot forging die using the Ni-based alloy for hot die of the present invention described above has a high high-temperature compressive strength and a tensile strength and is capable of achieving high productivity or long die service life, especially in large dies.

Method for Producing Forging Product

Representative steps in the case of producing a forging product by using the hot forging die using the Ni-based alloy for hot die of the present invention will be described.

First, a forging material is heated to a predetermined forging temperature as a first step. Since the forging temperature differs depending on materials, the temperature is appropriately adjusted. The hot forging die using the Ni-based alloy for hot die of the present invention has a property of being capable of being used in isothermal forging and hot die forging even at a high temperature in air, and thus, it is suitable for the hot forging of Ni-based heat-resistant superalloy, Ti alloy, or the like that are known as poor workability materials. Representative forging temperature is within a range of 1000 to 1150° C.

Then, the forging material heated in the first step is subjected to hot forging using the preheated hot forging die (second step). In the case of the hot die forging or the isothermal forging described above, the hot forging in the second step is preferably closed die forging. The Ni-based alloy for hot die of the present invention can be used in hot forging at a high temperature of 1000° C. or more in the air by adjusting the Cr content and the like, and can achieve high productivity and long die service life by adjusting the composition to have both high high-temperature compressive strength and tensile strength as described above.

EXAMPLES

The present invention will be described in more detail by way of the following examples. Ingots of the Ni-based alloy for hot die shown in Table 1 were produced by vacuum melting. The unit is mass %. In melting, various materials of which weights were adjusted so as to have a desired composition were made into a liquid at 1500 to 1600° C., and then cast into a ceramic casting mold preheated to 800 to 900° C. After casting, the alloy and the casting mold were left to stand for several hours to gradually cool down to room temperature, and after the slow cooling, the alloy and the casting mold were separated. The weight of the ingot was approximately 10 kg, and the approximate shape of the shape of the part without the push-bath was a cube having 100 mm on each side. Each of P, and O contained in the ingots described below was 0.005% or less. Each of Si, Mn, and Fe was 0.5% or less. In Table 1, Nos. 1 to 5 are "Examples" of the present invention. No. 21 is "Comparative Example", which is a Ni-based alloy for hot die that does not satisfy N and the relational expression 1 specified in the present invention.

TABLE 1

(mass %)

| No | Mo | W | Al | Cr | Ta | Ti | Nb | Co | Hf | Zr | La | Y | B | C | Mg | Ca | S | N | Balance |
|---|---|---|---|---|---|---|---|---|---|---|---|---|---|---|---|---|---|---|---|
| 1 | 3.6 | 13.9 | 5.5 | 1.6 | 3.19 | 1.6 | — | <0.01 | 0.17 | — | — | — | 0.02 | 0.11 | 0.0026 | — | 0.0008 | 0.0054 | Ni and inevitable impurities |
| 2 | 3.5 | 13.7 | 5.5 | 1.5 | 3.22 | 1.5 | — | <0.01 | 0.12 | — | — | — | 0.01 | 0.10 | 0.0029 | — | 0.0004 | 0.0084 | Same as above |
| 3 | 2.0 | 13.8 | 5.7 | 1.6 | 3.16 | 1.0 | 0.5 | 4.97 | 0.16 | — | — | — | 0.02 | 0.10 | 0.0008 | — | 0.0007 | 0.0042 | Same as above |
| 4 | 2.0 | 13.8 | 5.7 | 1.6 | 3.19 | 1.0 | 0.5 | 5.01 | — | 0.16 | — | — | 0.02 | 0.10 | 0.0002 | 0.0006 | 0.0004 | 0.0043 | Same as above |
| 5 | 2.0 | 13.8 | 5.7 | 1.6 | 3.17 | 1.0 | 0.5 | 4.99 | — | — | 0.003 | 0.003 | 0.01 | 0.10 | 0.0002 | — | 0.0005 | 0.0044 | Same as above |
| 21 | 3.5 | 13.8 | 5.4 | 1.6 | 3.22 | 1.5 | — | <0.01 | 0.12 | — | — | — | 0.01 | 0.10 | 0.0019 | — | 0.0003 | 0.0003 | Same as above |

* The symbol "—" means no addition.

Cubes having a side of 10 mm were cut out from each of the ingots and their surfaces were polished so as to be equivalent to the one equivalent to #1000 to produce oxidation test specimens, and then the oxidation resistance was evaluated. In the oxidation test, a test simulating repeated use in the air as a die for hot forging was carried out.

By using test specimens of alloy Nos. 1 to 5 of the Examples and alloy No. 21 of the Comparative Example, a heating test was performed as follows. The test specimens were loaded into a furnace heated to 1100° C. in a state of being placed in a ceramic container made of $SiO_2$ and $Al_2O_3$, held at 1100° C. for 3 hours, and then taken out of the furnace and air-cooled. The heating test was repeated 10 times by cooling and recharging to evaluate the oxidation resistance to repeated use.

For each test specimen, the surface area and the mass of the test specimen were measured before the first heating test, and the mass of the test specimen after cooling to room temperature after an even number of times of the first to tenth heating tests and removing surface scale by a blower was measured. The mass change per unit surface area of the test specimen after each test was calculated by subtracting the mass measured before the first test from the mass measured after each test and dividing the value by the surface area measured before the first test. The larger the absolute value of the mass change is, the larger the scale scattering amount per unit area is. The mass change after each number of repetitions was calculated as follows.

Mass change=(mass after the test−mass before the test)/surface area before the test The mass change per unit surface area of the test specimens calculated after the heating test of each holding time is shown in Table 2. The unit of the mass change is $mg/cm^2$. From Table 2, it can be seen that the weight reduction (excessive scattering of scale) did not occur in both the Examples and the Comparative Example, and both kinds of Examples had good oxidation resistance.

TABLE 2

| | Mass change after each heating test ($mg/cm^2$) | | | | |
|---|---|---|---|---|---|
| No. | 2 times | 4 times | 6 times | 8 times | 10 times |
| 1 | 0.4 | 0.7 | 0.9 | 1.1 | 1.3 |
| 2 | 0.5 | 0.8 | 1.0 | 1.2 | 1.5 |
| 3 | 1.1 | 1.5 | 1.7 | 2.0 | 2.1 |
| 4 | 0.9 | 1.3 | 1.6 | 1.9 | 2.1 |
| 5 | 0.8 | 1.3 | 1.6 | 1.8 | 2.0 |
| 21 | 0.7 | 1.0 | 1.3 | 1.5 | 1.6 |

Next, microstructures of the material were observed. Cubes having a side of 10 mm were cut out from each material of Examples Nos. 1 to 5 and Comparative Example No. 21, mirror polishing was performed by buffing with diamond paste, and the polished surface was etched with an etching solution comprising 50 ml of ethanol, 50 ml of concentrated hydrochloric acid of 35 mass %, and 2.6 g of cupric chloride to prepare test specimens for microstructure observation. Optical micrograph photos were taken at magnifications of 200 times and 500 times on the etched surfaces of the prepared test specimens. The collecting position of each material was substantially the same position in the equiaxed crystal region in the vicinity of the center of the ingot.

In order to evaluate the area fraction and the morphology of the constituent phases, optical micrograph photos were also taken at magnifications of 100 times and 1000 times for Examples Nos. 1 and 2 and Comparative Example No. 21. The fields of view area were approximately 2000000 $\mu m^2$ and approximately 100000 $\mu m^2$. The constituent phases identified in each material were γ/γ' phase, eutectic γ' phase, $M_6C$ carbide and MC carbide, using area fraction measurements for eutectic γ' phase and $M_6C$ carbides and morphology evaluation for MC carbides. MC carbide and $M_6C$ carbide were identified by field emission-electron probe microanalyzer (FE-EPMA) and SEM observation, and EDX analysis. In the area fraction measurement of the eutectic γ' phase, 100 times optical micrograph photos were taken in a freely chosen area, the eutectic γ' phase in the printed photographs was highlighted with a marking pen, and the images were taken and analyzed using the image processing software ImageJ. In the area fraction measurement of the $M_6C$ carbide, a total of five 100 times optical micrograph photos were taken close proximity areas due to the small area fraction, analyzed in the same method, and the average of the five photographs was used as the area fraction. The field of view area of each photograph was approximately 2000000 $\mu m^2$. In the morphology evaluation of the MC carbides, a total of five 1000 times optical micrograph photos were taken so that the number of pieces of carbides to be evaluated was 300 or more, and the circularity defined by the following expression was calculated using the image processing software ImageJ. The field of view area of each photograph was approximately 100000 $\mu m^2$. In this analysis, the distinction between $M_6C$ and MC carbides is based on their area, and carbides smaller than 200 $\mu m^2$ were considered MC carbides. Here, MC carbides of less than 0.25 $\mu m^2$ were excluded from the measurement.

$$\text{Circularity}=(4\times\pi\times\text{area of carbide})/(\text{perimeter of carbide})^2$$

In addition, observation using FE-EPMA, acquisition of an element map, observation using SEM, and EDX analysis were performed on Example No. 1 and Comparative Example No. 21.

FIGS. 1A-1F show 200 times and 500 times optical micrograph photos of Examples Nos. 1 and 2 and Comparative Example No. 21. In all materials, the constituent phases are eutectic γ' phase, $M_6C$ carbide and MC carbide. Although there is no significant difference between the materials in the eutectic γ' phase, the $M_6C$ carbide is slightly smaller in the Examples, and in addition, there is a clear difference in the MC carbide, as shown in the 500 times optical micrograph photos. In Comparative Example No. 21, which contains Ti and C but inevitably contains only a trace amount of N, branched carbides, commonly referred to as Chinese-script, are present in a relatively aggregated form. In addition, in Examples Nos. 1 and 2 with a large amount of N intentionally added in addition to Ti and C, carbides having a block morphology are present in a relatively dispersed state. Table 3 shows the area fraction of each eutectic γ' phase and $M_6C$ carbide. The area fraction of the eutectic γ' phase is almost the same, but the $M_6C$ carbide is slightly lower in the Examples.

Figure 2A:
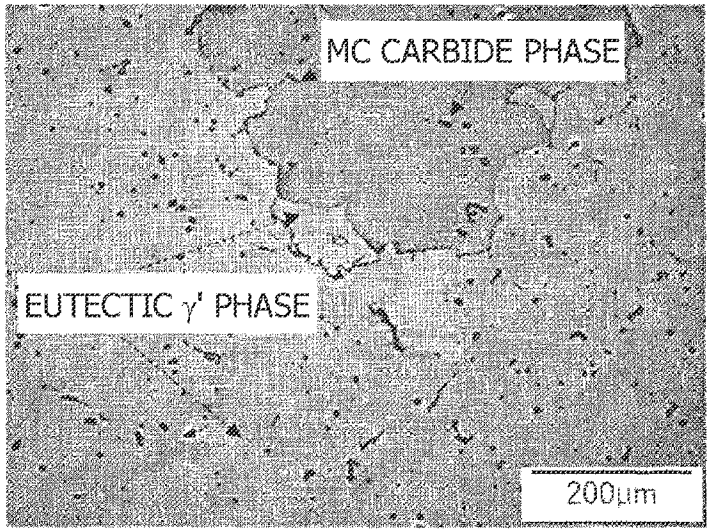
FIGS. 2A-2C show optical micrograph photos of microstructures of the examples.
Figure 2B:
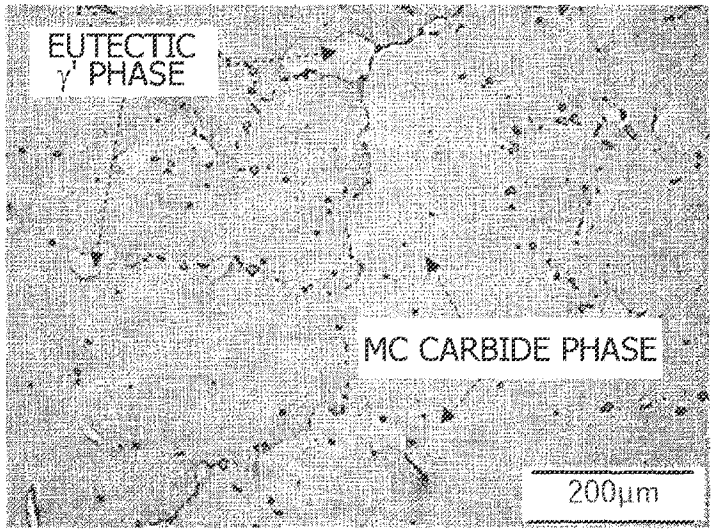
Figure 2C:
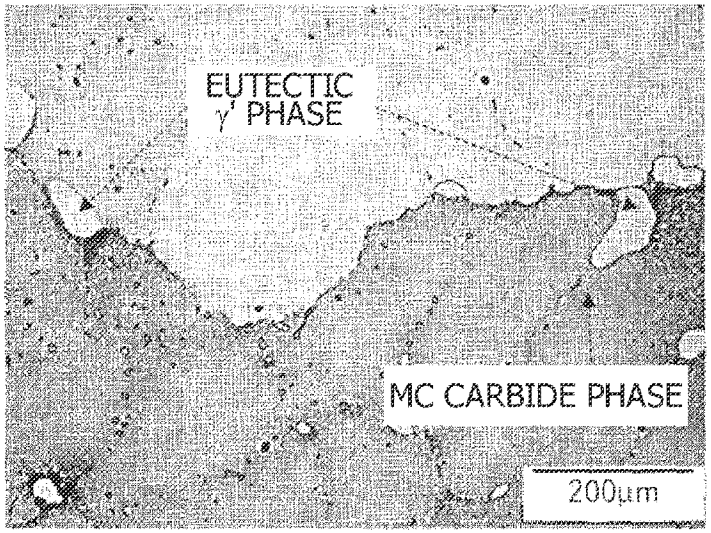

Furthermore, FIGS. 2A-2C show optical micrograph photos of Examples Nos. 3 to 5. The Mo content of these alloys was 2.0 mass %, which is small as compared with Nos. 1, 2, and 21 of the Ni-based alloys for hot die described above, the constituent phases are mainly eutectic γ' phase and MC carbide. In these examples in which the $M_6C$ carbide is almost absent, in Examples Nos. 3 to 5 having an appropriate amount of N intentionally added in addition to Ti and C, branched carbides are not confirmed, and carbides having a block morphology are present in a relatively dispersed state.

TABLE 3

| | Area fraction (%) | |
|---|---|---|
| No. | Eutectic γ' phase | $M_6C$ carbide |
| 1 | 10.61 | 1.1 ± 0.2 |
| 2 | 10.56 | 0.3 ± 0.1 |
| 21 | 10.63 | 1.2 ± 0.7 |

Figure 3:
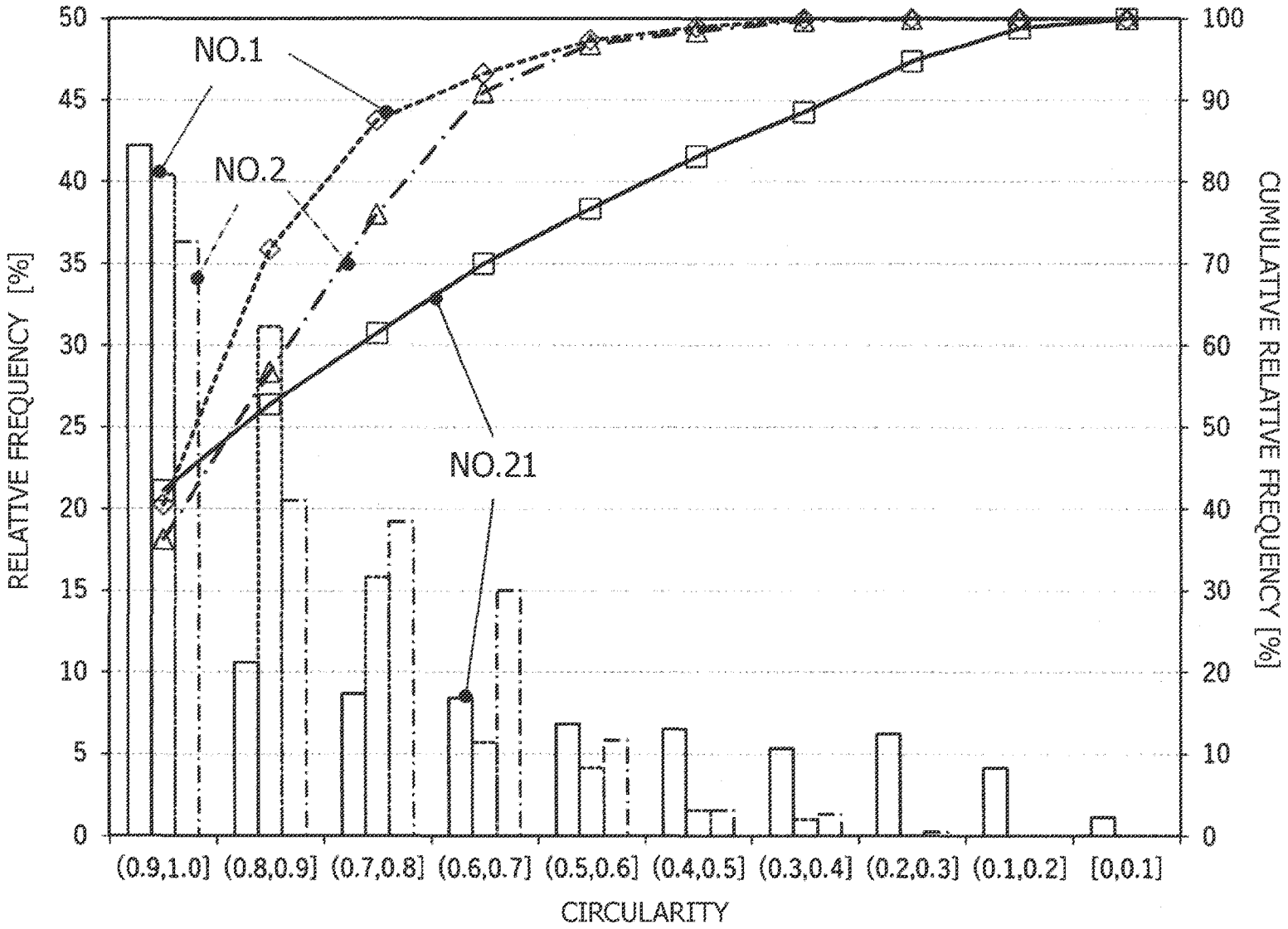
FIG. 3 is a graph showing the relative frequency and the cumulative relative frequency of the circularity of MC carbides of the examples and the comparative example.

FIG. 3 shows the evaluation results of circularity of the MC carbides of Examples Nos. 1 and 2 and Comparative Example No. 21. The horizontal axis represents the class of the histogram, with "(a, b]" representing a left-open right-closed interval and "[a, b]" representing a closed interval. The vertical axis represents the relative frequency and the cumulative relative frequency of the class, respectively, and the bar graph represents the relative frequency and the line graph represents the cumulative relative frequency. In Comparative Example No. 21, which inevitably contains only a trace amount of N, has a lower percentage of MC carbides with a high circularity as compared with Examples Nos. 1 and 2, and the cumulative relative frequency of MC carbides having a circularity greater than 0.5 in Comparative Example No. 21 is approximately 80%, while the cumulative relative frequencies of MC carbides having a circularity greater than 0.5 in the Examples are 95% or more, 97% in Example No. 1 and 97% in Example No. 2 which are almost 100%. Furthermore, when Examples Nos. 1 and 2 are compared, the ratio of MC carbide having a circularity close to 1 is higher in No. 1 than in No. 2 having a large N content, reflecting the difference in the tendency of aggregation and coarsening of nitride due to the difference in the N content. In the analysis of Comparative Example No. 21, the total number of pieces of MC carbides was 679, but in Examples Nos. 1 and 2, aggregation was relatively suppressed, so that the number of MC carbides was 385 in No. 1 and 380 in No. 2. In the carbides of the Examples, carbides having a length to width ratio of 10 or more were not confirmed, but were 0%, which is 5% or less. From these results, it was confirmed that the ratio of carbides having a circularity greater than 0.5 was 90% or more and that of the branched carbides having a length to width ratio of 10 or more was 10% or less among carbides having a size of 0.25 to 200 $\mu m^2$ in Nos. 1 and 2 of the Ni-based alloy for a hot die of the present invention. Furthermore, in Nos. 3 to 5 of the Ni-based alloy for a hot die of the present invention, the ratio of carbides having a circularity greater than 0.5 among carbides having a size of 0.25 to 200 $\mu m^2$ was 96% in No. 3, 100% in No. 4, and 99% in No. 5 of the Examples, and branched carbides having a length to width ratio of 10 or more were not confirmed and were 0%, which is 5% or less. The total number of pieces of MC carbides analyzed was 237 in No. 3, 108 in No. 4, and 110 in No. 5 of the Examples. The optical micrograph photo used is shown in FIGS. 2A-2C.

FIGS. 4A-4B show the FE-EPMA observation results of Example No. 1 and Comparative Example No. 21. In the element maps, the brighter the color is, the higher the concentration of the target element is. Both the branched phase of Comparative Example No. 21 and the phase having a block morphology of Example No. 1 shown in the back-scattered electron image have a high concentration of C and Ti, indicating that they are MC carbides. However, while the former has a low concentration of N, the latter has a high concentration.

Figure 5A:
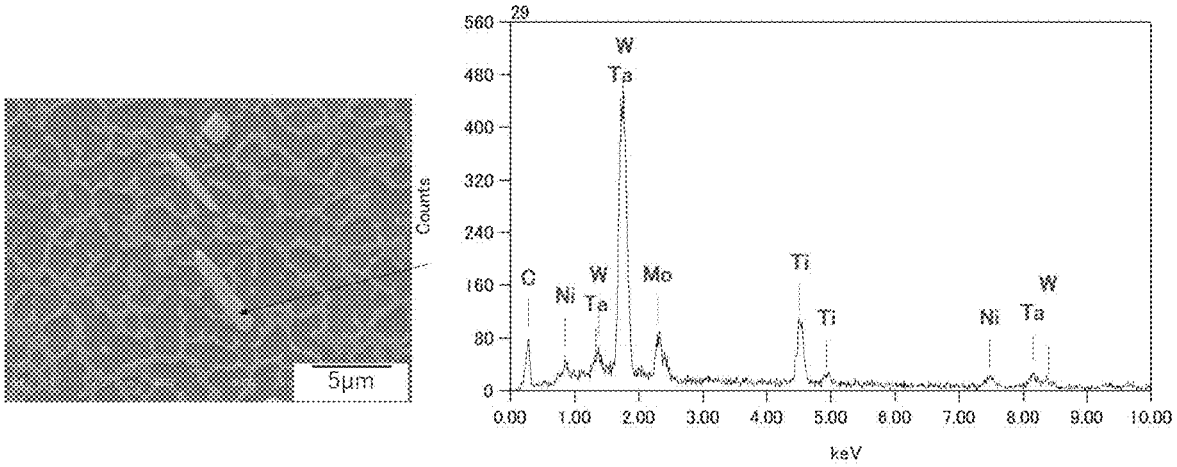
FIGS. 5A-5B show electron microscopy secondary electron images and energy dispersive X-ray analysis results of MC carbides of the example and the comparative example.
Figure 5B:
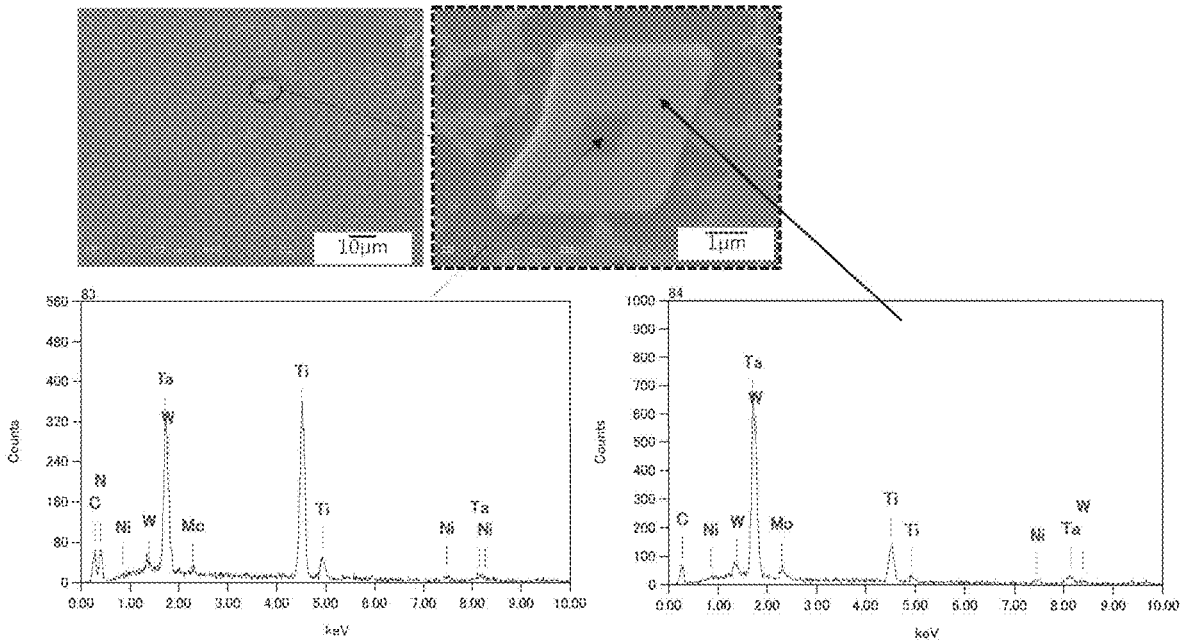

FIGS. 5A-5B show SEM observation and energy dispersive X-ray analysis results of Example No. 1 and Comparative Example No. 21. The white phase of Comparative Example No. 21 is MC carbide composed of W, Mo, Ta, Ti and C. In addition, in Example No. 1, a black nucleus is present at the center, and analysis of the nucleus and its surroundings shows that there is an MC carbide with a TiN nucleus at the center.

From the observation and analysis results so far, it can be seen that in the alloy of the present invention with a large amount of N intentionally added in addition to Ti and C, the carbides have a block morphology and are present in a relatively dispersed state due to the formation of TiN nuclei.

Then, materials for collecting test specimens having a diameter of 8 mm and a height of 12 mm were cut out from the materials of Examples Nos. 1 to 5 and Comparative Example No. 21, and their surfaces were polished so as to be equivalent to #1000 to produce compression test specimens. By using these compression test specimens, the compression tests were performed. The collecting position of each material was substantially the same position in the equiaxed crystal region in the vicinity of the center of the ingot. The test conditions were a test temperature of 1100° C., a strain rate of $10^{-2}$/s, and a compression rate of 10%. Since the test specimens were small and the results varied according to the size of structures such as grains, the test was conducted three times for each material. The 0.2% compressive strength was derived from stress-strain curves obtained by the compression test and the high-temperature compressive strength was evaluated by the value obtained by averaging three times. This compression test is to test whether the die has enough compressive strength even under high temperature as the die for hot forging, and it can be said that the die has sufficient strength when the compressive strength thereof is 350 MPa or more at a test temperature of 1100° C. at which the isothermal forging is assumed. The compressive strength is preferably 400 MPa or more, and more preferably 450 MPa or more.

Table 4 shows the test results of test specimens of Examples Nos. 1 to 5 and Comparative Example No. 21. From Table 4, it can be seen that all the materials have a compressive strength of 350 MPa or more, and both sections of Examples have excellent high-temperature compressive strength.

TABLE 4

| No. | Compression test value (MPa) 1100° C. |
|---|---|
| 1 | 491 |
| 2 | 481 |
| 3 | 446 |
| 4 | 426 |
| 5 | 416 |
| 21 | 484 |

Then, tensile test specimens having a diameter of about 12 mm and a height of about 100 mm were prepared from the materials of Examples Nos. 1 to 5 and Comparative Example No. 21, and the test specimens were subjected to an ordinary temperature tensile test according to ASTM E 8 and a high temperature tensile test at 1100° C. according to ASTM E 21 to evaluate the tensile strengths of the materials. The collecting position of each material was substantially the same position in the equiaxed crystal region in the vicinity of the center of the ingot. The higher the tensile strength, the longer the high cycle fatigue life, so it can be said that high productivity or long die service life is achieved.

Figure 6A:
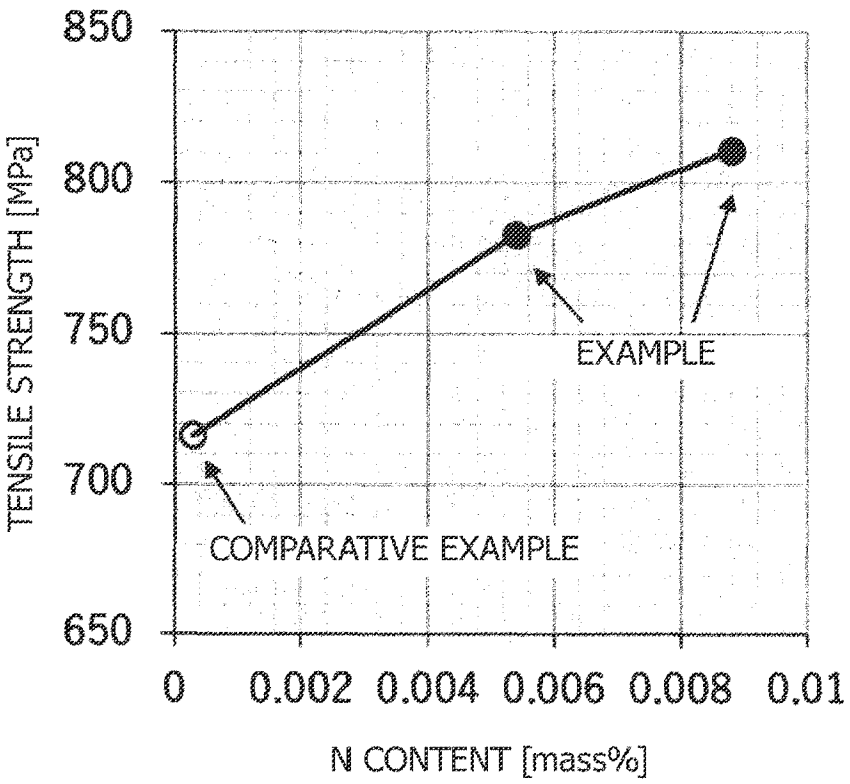
FIGS. 6A-6B show graphs of the tensile strengths of the examples and the comparative example.
Figure 6B:
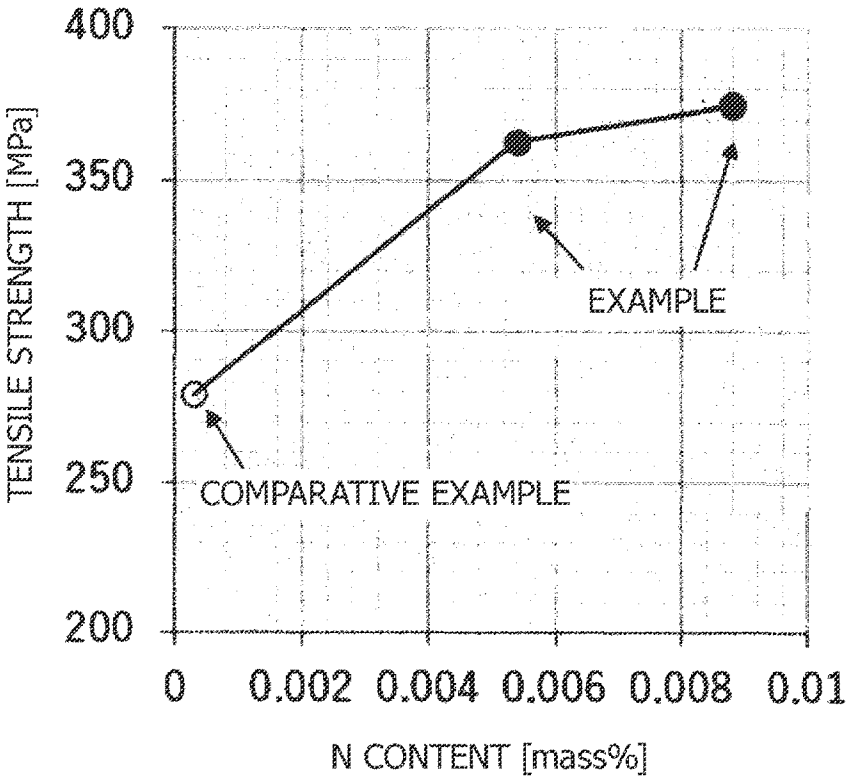
Figure 7A:
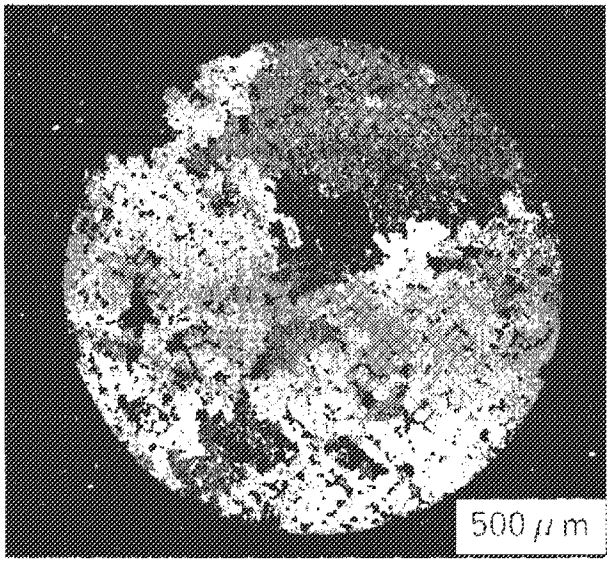
FIGS. 7A-7C show are optical micrograph photos of macrostructures of the cross-section of tensile test specimens of the examples and the comparative example.
Figure 7B:
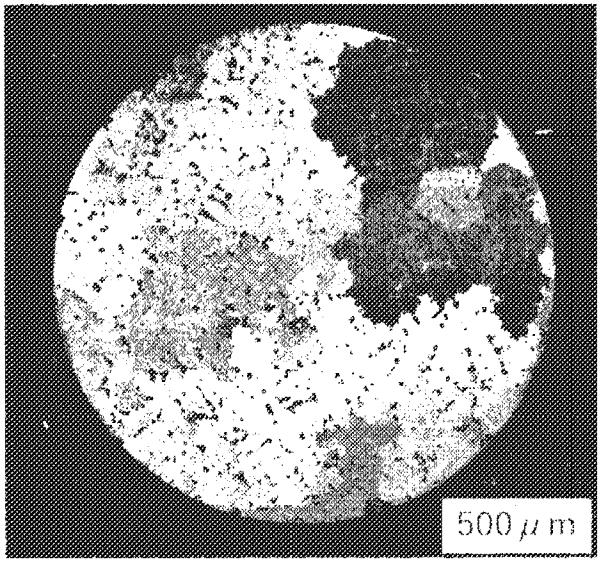
Figure 7C:
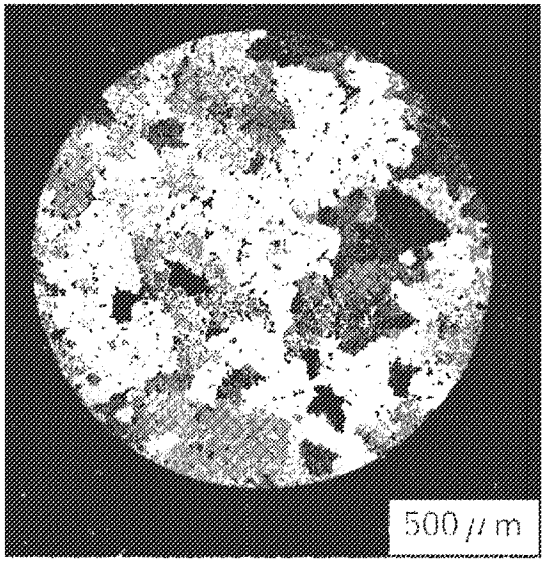

Table 5 shows the tensile strengths of Examples Nos. 1 to 5 and Comparative Example No. 21. Since the major difference in composition between Examples Nos. 1 and 2 and Comparative Example No. 21 is only the content of N, graphs in which the tensile strength of each material is arranged by the content of N are shown in FIGS. 6A-6B. FIGS. 7A-7C show microstructure photographs of the test specimens after the test at 1100° C. in the transverse direction at a position about 20 mm from the fracture surface in the direction of the threaded portion of the test specimens, with the observation surface adjusted in the same method as described above. FIGS. 9A-9F show microstructure photographs in the vicinity of the fracture surface of a longitudinal cross-section cut along the diameter of the fracture surface of the test specimens after tensile testing at room temperature and 1100° C. As shown in FIGS. 7A-7C, Example No. 2 has the smallest grain and Example No. 1 has the coarsest grain, which does not correspond to the tendency shown in FIGS. 5A-5B. In addition, as shown in FIGS. 9A-9F, along with cracks at grain boundaries and interfaces, many cracked $M_6C$ carbides were found in the longitudinal cross-section in the vicinity of the fracture surfaces at room temperature and 1100° C., and cracked MC carbides were found only in Comparative Example No. 21 at room temperature. From these facts and the measurement results of the area fraction of the eutectic γ' phase and the $M_6C$ carbide described above, it can be seen that the tensile strength at room temperature and 1100° C. was increased by the suppression of the formation of the $M_6C$ carbide, and the tensile strength at room temperature was increased by the change in the morphology and the degree of dispersion of the MC carbide in Examples Nos. 1 and 2 which intentionally contained a large amount of N in addition to Ti and C, in comparison with Comparative Example No. 21 which contains Ti and C but contained only a small amount of N.

TABLE 5

| No. | Tensile strength (MPa) room temperature (22° C.) | 1100° C. |
|---|---|---|
| 1 | 783 | 363 |
| 2 | 811 | 375 |
| 3 | 862 | 376 |
| 4 | 828 | 341 |
| 5 | 867 | 288 |
| 21 | 716 | 279 |

From the results so far, it can be seen that the Ni-based alloy for a hot die of the present invention has high high-temperature compressive strength, oxidation resistance, and tensile strength, and is capable of yielding high productivity or long die service life. The Ni-based alloy for hot die of the present invention described above can be processed into a predetermined shape to obtain a hot forging die. It can be seen that the hot forging die made of the Ni-based alloy for a hot die of the present invention having the aforementioned properties is suitable for hot die forging and isothermal forging.

The invention claimed is:

1. A Ni-based alloy for hot die consisting of, in mass %, W: 12.0 to 16.0%, Mo: 1.0 to 8.0%, Al: 5.0 to 7.5%, Cr: 0.5 to 5.0%, Ta: 0.5 to 7.0%, Ti: 0.1 to 3.5%, C: 0.01 to 0.25%, N: 0.0042 to 0.02%, B: 0.05% or less, S: 0.015% or less, one or two or more elements selected from rare earth elements, Y, Ca, and Mg: 0.020% or less in total, one or two elements selected from Zr and Hf: 1.5% or less in total, Nb: 3.5% or less, Co: 15.0% or less, the balance being Ni and inevitable impurities, wherein C and N satisfy the following relational expression 1:

$$C/100 \leq N \leq C,$$

wherein C and N in the expression mean mass % of each component content.

2. The Ni-based alloy for hot die according to claim 1, wherein when a cross-section of the Ni-based alloy for hot die is observed in a field of view area of at least 1000 $\mu m^2$, a ratio of carbides having a circularity greater than 0.5 among carbides having a size of 0.25 to 200 $\mu m^2$ seen in the field of view area is 90% or more.

3. The Ni-based alloy for hot die according to claim 1, wherein when a cross-section of the Ni-based alloy for hot die is observed in a field of view area of at least 1000 $\mu m^2$, a ratio of branched carbides having a length to width ratio of 10 or more among carbides having a size of 0.25 to 200 $\mu m^2$ seen in the field of view area is 10% or less.

4. A hot forging die using the Ni-based alloy for hot die according to claim 1.

5. The Ni-based alloy for hot die according to claim 1, wherein the content of N is in a range of 0.005 to 0.02%.

6. The Ni-based alloy for hot die according to claim 1, wherein C and N satisfy the following relational expression 2:

$$C/50 \leq N \leq C.$$

7. The Ni-based alloy for hot die according to claim 1, wherein C and N satisfy the following relational expression 3:

$$C/11.9 \leq N \leq C.$$

8. The Ni-based alloy for hot die according to claim 1, wherein the content of N is in a range of 0.0084 to 0.02%.

* * * * *